US007766666B1

(12) United States Patent
Chen et al.

(10) Patent No.: US 7,766,666 B1
(45) Date of Patent: Aug. 3, 2010

(54) BOARD-TO-BOARD CONNECTOR ASSEMBLY

(75) Inventors: Chung-Yu Chen, Tu-Cheng (TW); Yung-Chi Peng, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/541,140

(22) Filed: Aug. 13, 2009

(51) Int. Cl.
*H01R 12/00* (2006.01)

(52) U.S. Cl. ..... 439/65; 439/74

(58) Field of Classification Search ..... 439/64, 439/65, 74, 81, 83
See application file for complete search history.

(56) References Cited

U.S. PATENT DOCUMENTS 5,395,250 A * 3/1995 Englert et al. ..... 439/65
7,575,441 B1 * 8/2009 Huang et al. ..... 439/74
7,588,443 B2 * 9/2009 Wu et al. ..... 439/74
7,597,573 B2 * 10/2009 Defibaugh et al. ..... 439/206

* cited by examiner

*Primary Examiner*—Khiem Nguyen
(74) *Attorney, Agent, or Firm*—Cheng-Ju Chiang

(57) ABSTRACT

A board-to-board connector assembly includes a receptacle connector having a plurality of first terminals, and a plug connector having a plurality of second terminals. Each of the first terminals has a first contact portion and a second contact portion and each of the second terminals has a first contact arm and a second contact arm. When the plug connector is mated with the receptacle connector, the first contact portion and the second contact portion of the first terminal electrically contact the first contact arm and the second contact arm of the corresponding second terminal respectively to make the first terminal and the corresponding second terminal electrically interconnected steadily.

17 Claims, 5 Drawing Sheets

BOARD-TO-BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

A conventional board-to-board connector assembly includes a receptacle connector and a plug connector. The receptacle connector has a plurality of first terminals each having a contact portion. The plug connector has a plurality of second terminals each having a contact arm. When the plug connector is mated with the receptacle connector, the contact portions electrically contact the corresponding contact arms to make the first terminals and the corresponding second terminals electrically interconnected. However, each of the first terminals contacts the respective second terminal merely in one single point. As a result, when the board-to-board connector assembly is shaken in use, the contact portion is apt to depart from the corresponding contact arm that makes signal transmission between the first terminal and the corresponding second terminal broken easily. Therefore, a board-to-board connector assembly capable of overcoming the above-mentioned problems is required.

SUMMARY OF THE INVENTION

An object of the present invention is to provide a board-to-board connector assembly including a receptacle connector and a plug connector. The receptacle connector includes a receptacle housing and a plurality of first terminals. The receptacle housing has a flat first base board, two first sidewalls protruded upward from two opposite sides of the first base board and an inserting wall protruded upward from the first base board between the first sidewalls. A pair of first receiving recesses is formed between the inserting wall and the corresponding first sidewalls. The receptacle housing defines a plurality of terminal passageways extended longitudinally and communicating with the corresponding first receiving recesses. Each of the first terminals is disposed in the corresponding terminal passageway and has a base arm extending longitudinally. Two opposite ends of the base arm extend upward to form a first elastic arm and a fixing arm respectively. A portion of the base arm further extends upward to form a second elastic arm located between the first elastic arm and the fixing arm. A free end of the first elastic arm protrudes towards the second elastic arm to form a first contact portion. A free end of the second elastic arm protrudes substantially towards the first contact portion to form a second contact portion. The first and the second contact portions stretch into the corresponding first receiving recess. The plug connector is mated with the receptacle connector and includes a plug housing and a plurality of second terminals. The plug housing has a flat second base board and two second sidewalls protruded downward from two opposite sides of the second base board to be inserted in the corresponding first receiving recesses of the receptacle housing. A receiving chamber is formed between the second sidewalls for receiving the inserting wall therein. The second terminals are mounted to the second sidewalls and each has a U-shaped continuity body riding on the corresponding second sidewall. The continuity body includes a first contact arm located in the receiving chamber against an inside of the corresponding second sidewall and a second contact arm against an outside of the corresponding second sidewall. The continuity body of the second terminal is clipped between the first and the second elastic arms of the corresponding first terminal, and the first and the second contact portions elastically contact the first and the second contact arms respectively so that can ensure a steady electrical connection between the first terminal and the corresponding second terminal.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
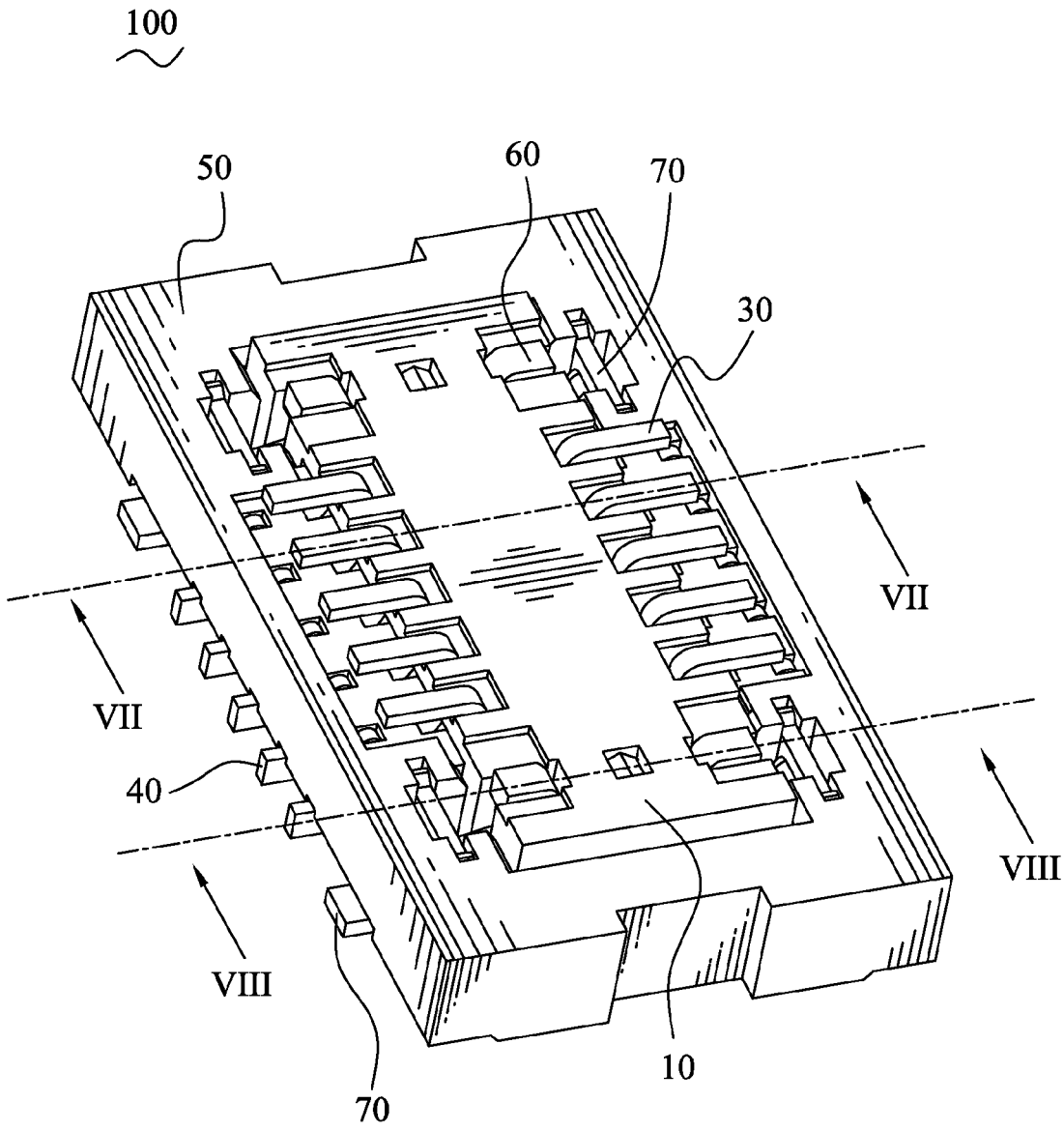
FIG. 1 is a perspective view of a board-to-board connector assembly in accordance with the present invention.
Figure 2:
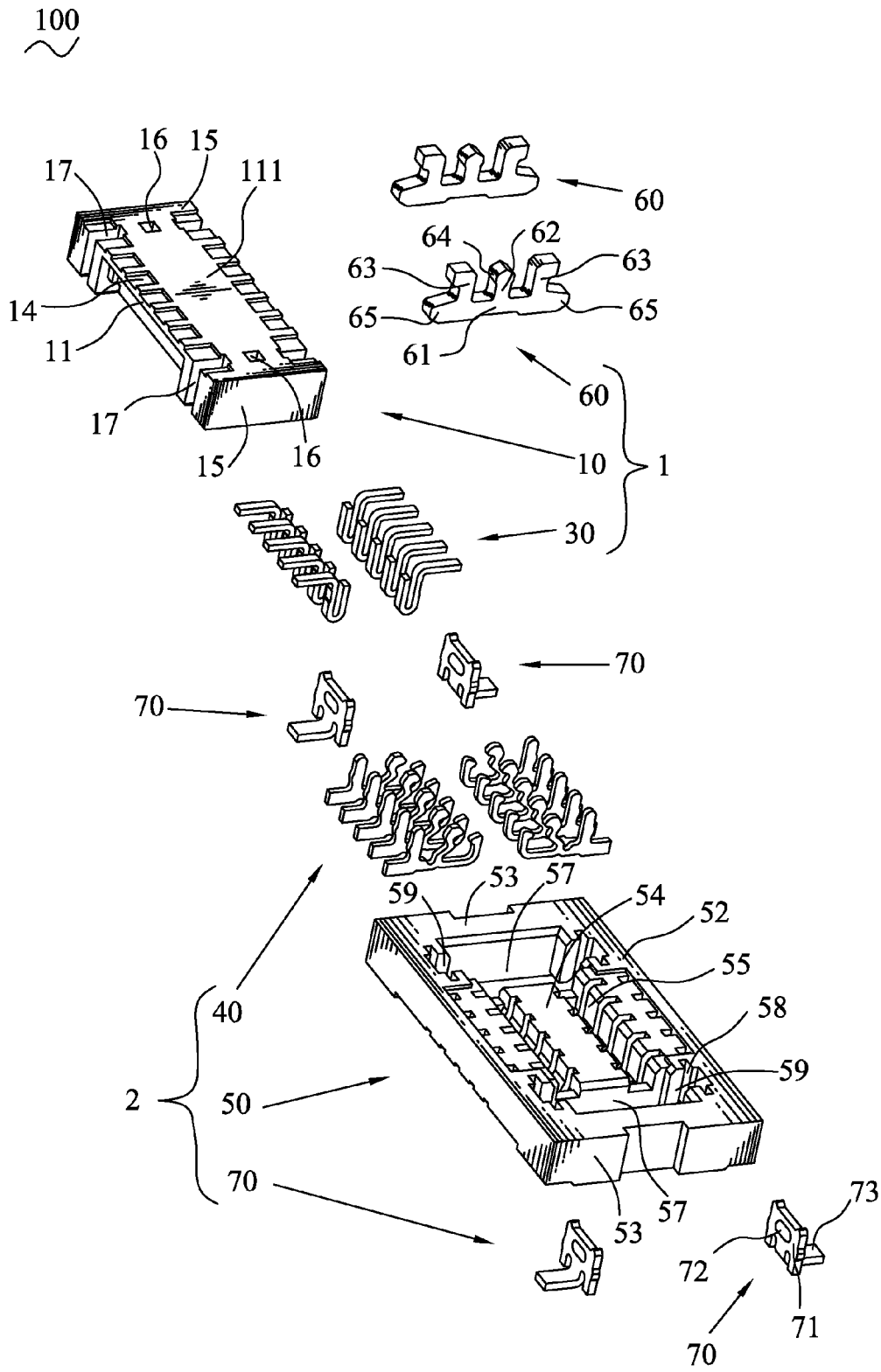
FIG. 2 is an exploded perspective view of the board-to-board connector assembly of FIG. 1.

Referring to FIG. 1 and FIG. 2, a board-to-board connector assembly 100 in accordance with the present invention includes a receptacle connector 2 and a plug connector 1 which are mounted to a female and a male printed circuit boards (not shown) to make the printed circuit boards electrically connected with each other.

Referring to FIG. 2 again, the receptacle connector 2 includes a receptacle housing 50, a plurality of first terminals 40 and four first fixing members 70 disposed in the receptacle housing 50 respectively.

Figure 3:
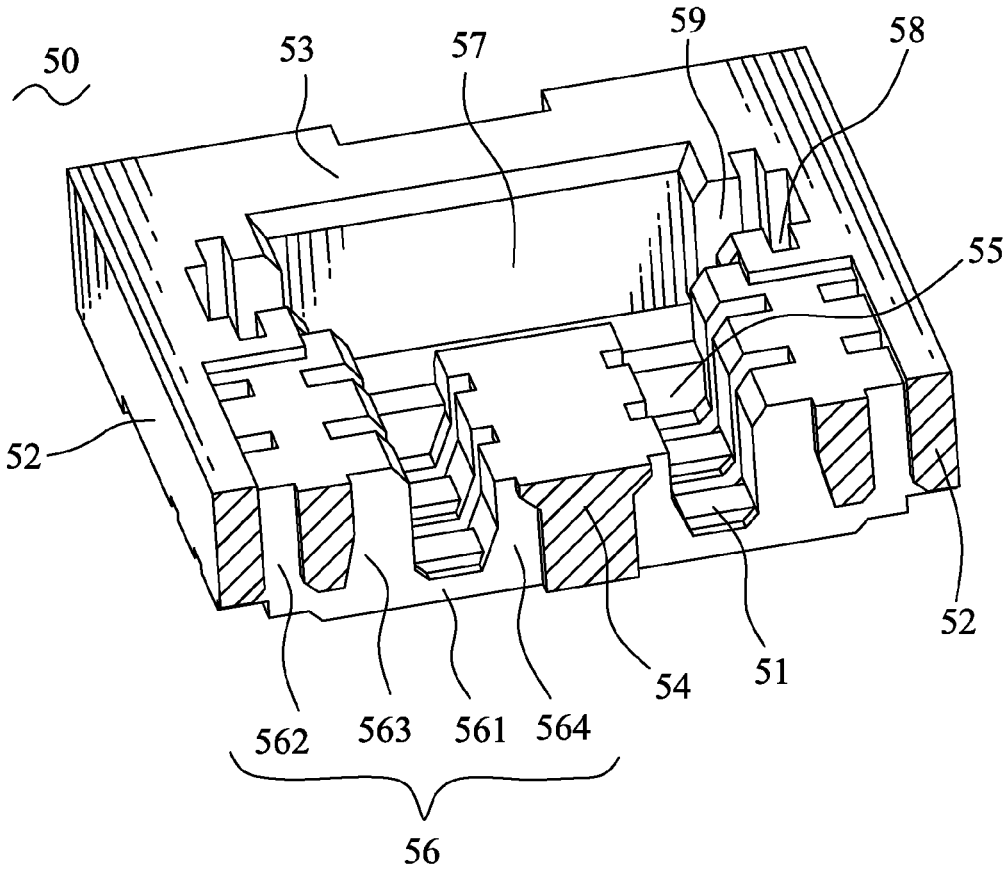
FIG. 3 is a cutaway perspective view of a receptacle housing of the board-to-board connector assembly of FIG. 1.

Referring to FIGS. 2 and 3, the receptacle housing 50 is rectangular and has a flat first base board 51. Two opposite sides of the first base board 51 protrude upward to form a pair of first sidewalls 52 extending longwise. Two opposite ends of the first base board 51 protrude upward to form a pair of first end-walls 53 each connecting two corresponding ends of the first sidewalls 52. A middle of the first base board 51 protrudes upward to form an inserting wall 54 extending longwise between the first sidewalls 52. Two opposite ends of the inserting wall 54 are spaced from the corresponding first end-walls 53. A pair of first receiving recesses 55 is formed between the inserting wall 54 and the corresponding first sidewalls 52, and a pair of rectangular second receiving recesses 57 is respectively formed among one end of the inserting wall 54, the two corresponding ends of the first sidewalls 52 and the corresponding first end-wall 53 and communicates with the first receiving recesses 55. Each of the second receiving recesses 57 further extends downward to penetrate through the first base board 51. Each of the two ends of each first sidewall 52 defines a fixing slot 58 extending along the longwise direction thereof, and a connecting passage 59 connecting a middle of the fixing slot 58 and the second receiving recess 57, wherein the fixing slot 58 and the connecting passage 59 further penetrate through the first sidewall 52 from top to bottom.

Two opposite sides of the inserting wall 54 vertically define a plurality of first receiving cavities 564 arranged at regular intervals along a longwise direction thereof and communicating with the corresponding first receiving recesses 55. An inside of each of the first sidewalls 52 vertically defines a plurality of second receiving cavities 563 one-on-one facing the first receiving cavities 564 and communicating with the respective first receiving recess 55. Each of the first sidewalls 52 further defines a plurality of fixing perforations 562 each extending vertically to penetrate therethrough and aligned with the corresponding first and second receiving cavities 564, 563 to be further connected together by a connecting cavity 561 in the first base board 51. The connecting cavity 561, the fixing perforation 562, the first receiving cavity 564 and the second receiving cavity 563 are combined together to form a terminal passageway 56.

Figure 4:
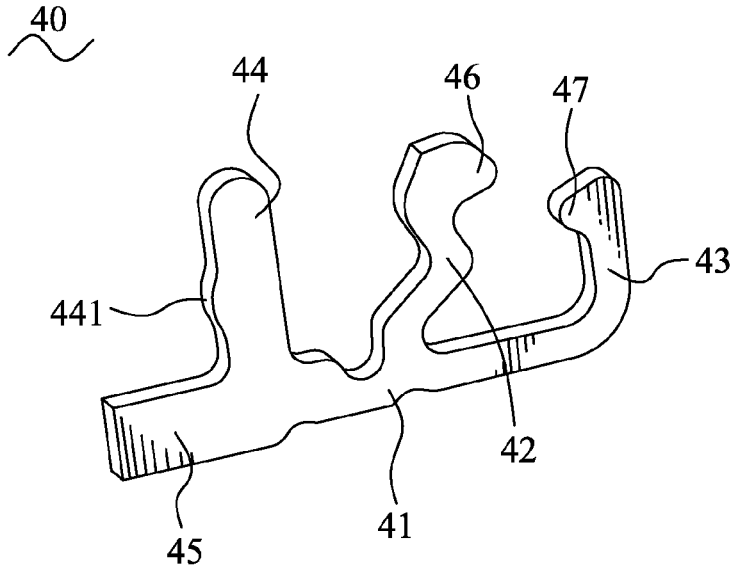
FIG. 4 is a perspective view of a first terminal of the board-to-board connector assembly of FIG. 1.

Referring to FIG. 4, each of the first terminals 40 has a bar-shaped base arm 41 extending longitudinally. Two opposite ends of the base arm 41 extend upward to form a first elastic arm 43 and a fixing arm 44 respectively, and a substantial middle of the base arm 41 extends upward to form a second elastic arm 42 located between the first elastic arm 43 and the fixing arm 44 and higher than the first elastic arm 43. The second elastic arm 42 is bent towards the first elastic arm 43 to show a lying-V shape for strengthening self-elasticity thereof. A free end of the first elastic arm 43 protrudes towards the second elastic arm 42 to form a first contact portion 47, and a free end of the second elastic arm 42 protrudes substantially towards the first contact portion 47 to form a second contact portion 46 higher than the first contact portion 47. An edge of the fixing arm 44 protrudes outward to form a fixing projection 441. The end of the base arm 41 adjacent to the fixing arm 44 further longitudinally extends to form a soldering portion 45.

Referring to FIG. 2 again, each of the first fixing members 70 has a base plate 71 and a soldering tail 73 extended perpendicularly to the base plate 71 from a middle of an edge of the base plate 71. A middle of the base plate 71 protrudes towards an opposite direction to the soldering tail 73 to form an interference portion 72.

Referring to FIG. 2, FIG. 3, FIG. 7 and FIG. 8, when the receptacle connector 2 is assembled, the first terminals 40 are received in the respective terminal passageways 56 of the receptacle housing 50. The base arm 41 of each of the first terminals 40 is received in the connecting cavity 561. The fixing arm 44 is inserted in the fixing perforation 562 and the fixing projection 441 abuts against an inside of the fixing perforation 562. The first elastic arm 43 is received in the first receiving cavity 564, the second elastic arm 42 is received in the second receiving cavity 563, and the first and the second contact portions 47, 46 stretch into the corresponding first receiving recess 55. The soldering portion 45 is located under the corresponding first sidewall 52 for being electrically soldered to the female printed circuit board. The first fixing members 70 are mounted to the two ends of the corresponding first sidewalls 52, wherein the base plate 71 is fastened in the corresponding fixing slot 58, the interference portion 72 is projected into the corresponding connecting passage 59 and the soldering tail 73 is located under the corresponding first sidewall 52 for being soldered to the female printed circuit board.

Referring to FIG. 2 again, the plug connector 1 includes a plug housing 10 mated with the receptacle housing 50, a plurality of second terminals 30 and two second fixing members 60 disposed in the plug housing 10 respectively.

Figure 5:
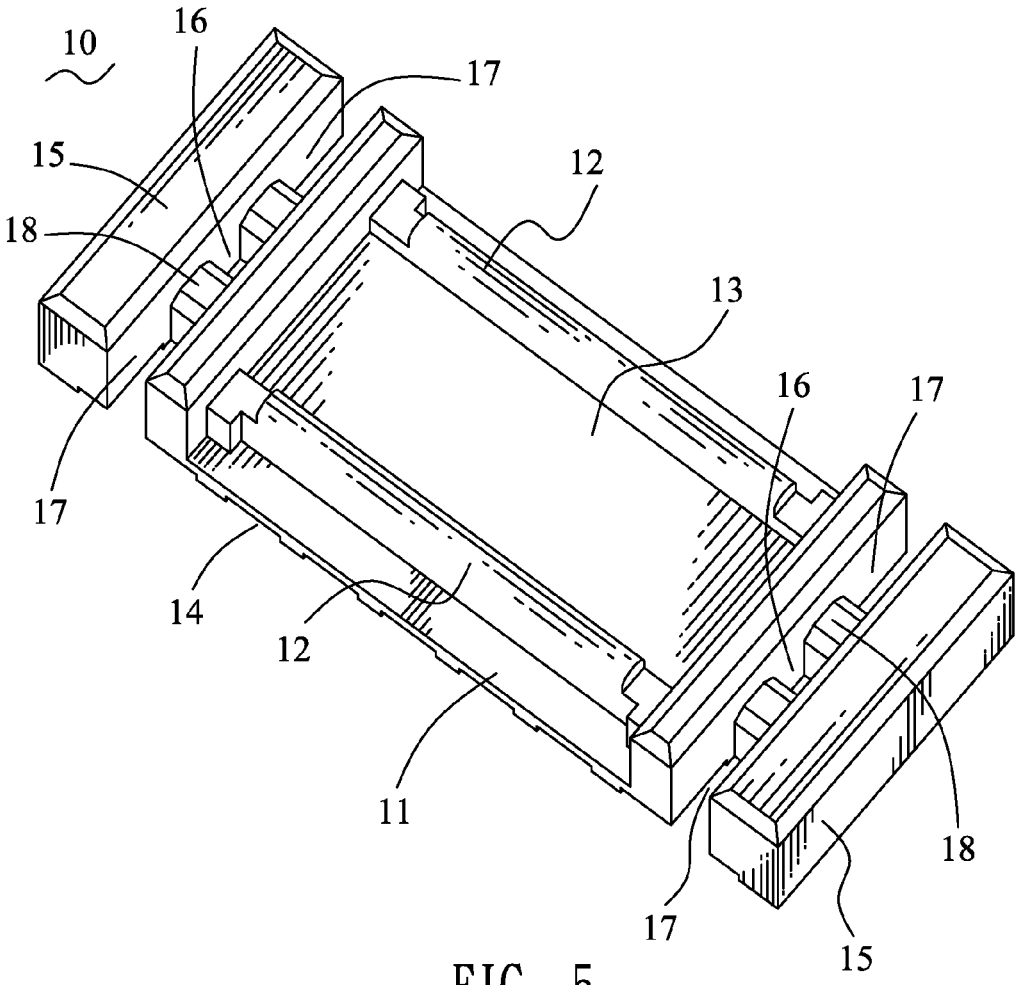
FIG. 5 is a perspective view of a plug housing of the board-to-board connector assembly of FIG. 1.

Referring to FIG. 2 and FIG. 5, the plug housing 10 is rectangular and has a flat second base board 11. Two opposite sides of the second base board 11 protrude downward to form a pair of second sidewalls 12 extending longwise. Two opposite ends of the second base board 11 protrude downward to form a pair of second end-walls 15 each connecting two corresponding ends of the second sidewalls 12 and having a lower bottom than the second sidewalls 12. A rectangular receiving chamber 13 is surrounded by the second sidewalls 12, the second end-walls 15 and the second base board 11. The second base board 11 has a top surface 111 back to the receiving chamber 13. Two opposite sides of the top surface 111 respectively define a plurality of terminal grooves 14 arranged at regular intervals along a longwise direction thereof. A bottom of each of the second end-walls 15 defines a receiving channel 18 extending longitudinally to penetrate therethrough. Two opposite ends of the receiving channel 18 further extend upward to penetrate through two opposite outsides and a top of the second end-wall 15 to form a pair of receiving fillisters 17, and a middle of the receiving channel 18 further extends upward to penetrate through the top of the second end-wall 15 to form an inserting aperture 16 between the receiving fillisters 17.

Figure 6:
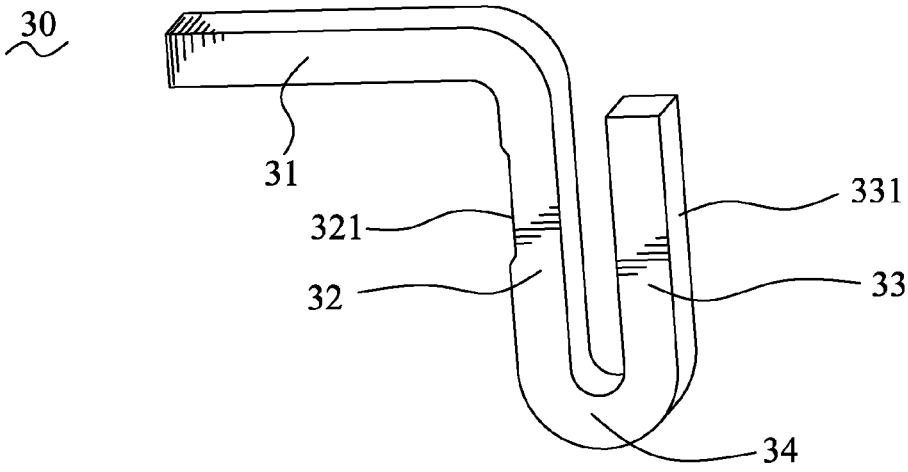
FIG. 6 is a perspective view of a second terminal of the board-to-board connector assembly of FIG. 1.
Figure 7:
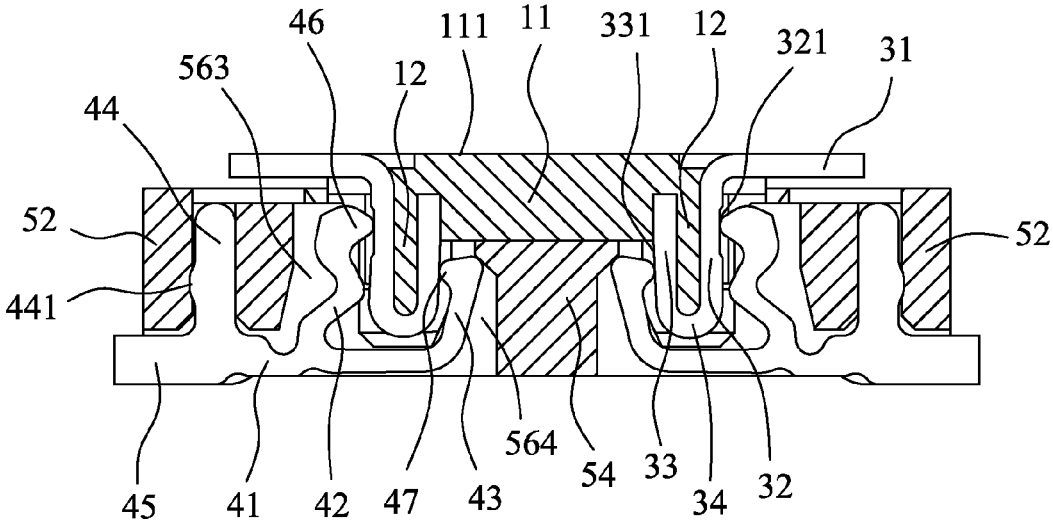
FIG. 7 is a cross-sectional view of the board-to-board connector assembly along line VII-VII of FIG. 1.

Referring to FIG. 6 and FIG. 7, the second terminals 30 are integrated to the second sidewalls 12 of the plug housing 10. Each of the second terminals 30 is provided with a U-shaped continuity body 34 riding on the corresponding second sidewall 12, and a bar-shaped soldering arm 31. The continuity body 34 includes a first contact arm 33 located in the receiving chamber 13 against an inside of the corresponding second sidewall 12 and having a free end embedded in the second base board 11, and a second contact arm 32 against an outside of the corresponding second sidewall 12 and having a free end embedded in the second base board 11. The first contact arm 33 defines a first contact surface 331 opposite to the second contact arm 32, and the second contact arm 32 defines a second contact surface 321 opposite to the first contact arm 33 and slightly sunk inward. The soldering arm 31 is shaped by extending towards an opposite direction to the first contact arm 33 from the free end of the second contact arm 32 and perpendicular to the second contact arm 32. The soldering arm 31 is disposed in the corresponding terminal groove 14 and further projected out of a corresponding side edge of the second base board 11 for being electrically soldered to the male printed circuit board.

Figure 8:
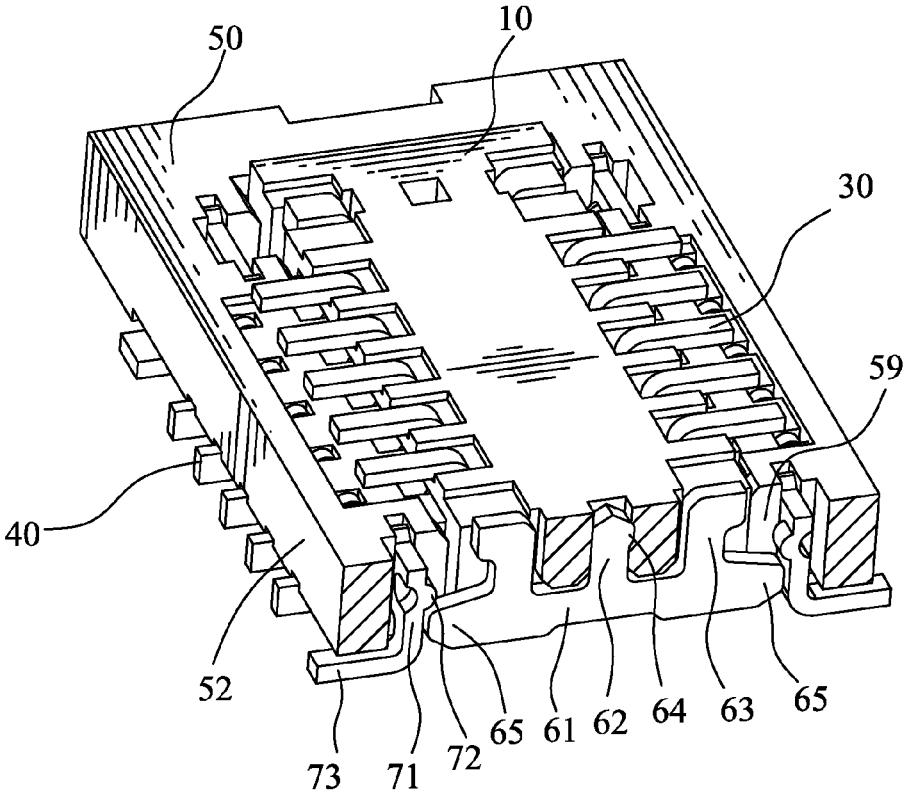
FIG. 8 is a cutaway perspective view of the board-to-board connector assembly along line VIII-VIII of FIG. 1.

Referring to FIG. 2, FIG. 5 and FIG. 8, each of the second fixing members 60 has a base bar 61 extending longitudinally, an inserting portion 62 extended upward from a middle of the base bar 61, and two fastening portions 63 extended upward from two ends of the base bar 61. A free end of the inserting portion 62 oppositely protrudes to form a pair of fixing protrusions 64. Two opposite ends of the base bar 61 further oppositely longitudinally extend to form a pair of locking portions 65 adjacent to the corresponding fastening portions 63 respectively. The second fixing members 60 are mounted in the corresponding second end-walls 15. The base bar 61 is received in the receiving channel 18. The inserting portion 62 is inserted in the inserting aperture 16 and the fixing protrusions 64 abut against two facing insides of the inserting aperture 16. The fastening portions 63 are fastened in the corresponding receiving fillisters 17, and the locking portions 65 oppositely project out of the corresponding second end-wall 15.

Referring to FIG. 1, FIG. 2, FIG. 7 and FIG. 8 again, when the plug connector 1 is engaged with the receptacle connector 2, the second end-walls 15 of the plug housing 10 are firstly inserted into the respective second receiving recesses 57 of the receptacle housing 50, then the second sidewalls 12 are inserted into the corresponding first receiving recesses 55 and the inserting wall 54 is received in the receiving chamber 13 so that can ensure the first terminals 40 rightly electrically connected with the corresponding second terminals 30 for further making the printed circuit boards electrically connected with each other, wherein the continuity body 34 of the second terminal 30 is clipped between the first and the second elastic arms 43, 42 of the corresponding first terminal 40 to make the first contact portion 47 and the second contact portion 46 electrically abut against the first contact surface 331 of the first contact arm 33 and the second contact surface 321 of the second contact arm 32 respectively. In the process of the plug connector 1 inserted into the receptacle connector 2, each of the locking portions 65 of the second fixing member 60 is firstly inserted into the corresponding connecting passage 59 and then passes across the corresponding interference portion 72 to be locked under the interference portion 72 so as to ensure a firm engagement between the plug connector 1 and the receptacle connector 2.

As described above, the continuity body 34 of the second terminal 30 is clipped between the elastic arms 43, 42 of the corresponding first terminal 40 to make the contact portions 47, 46 elastically abut against the contact arms 33, 32 respectively so that ensures a steady electrical connection between the first terminal 40 and the corresponding second terminal 30. Furthermore, the second elastic arm 42 is designed to show a vertical-V shape so that strengthens the self-elasticity thereof to prevent the first terminal 40 from being damaged during inserting/withdrawing the plug connector 1 into/out of the receptacle connector 2.

What is claimed is:

1. A board-to-board connector assembly, comprising:

a receptacle connector having:

a receptacle housing having a flat first base board, two first sidewalls protruded upward from two opposite sides of the first base board and an inserting wall protruded upward from the first base board between the first sidewalls, a pair of first receiving recesses being formed between the inserting wall and the corresponding first sidewalls, the receptacle housing defining a plurality of terminal passageways extended longitudinally and communicating with the corresponding first receiving recesses; and a plurality of first terminals disposed in the corresponding terminal passageways and each having a base arm extending longitudinally, two opposite ends of the base arm extending upward to form a first elastic arm and a fixing arm respectively, a portion of the base arm further extending upward to form a second elastic arm located between the first elastic arm and the fixing arm, a free end of the first elastic arm protruding towards the second elastic arm to form a first contact portion, a free end of the second elastic arm protruding substantially towards the first contact portion to form a second contact portion, the first and the second contact portions stretching into the corresponding first receiving recess; and a plug connector mated with the receptacle connector and having:

a plug housing having a flat second base board and two second sidewalls protruded downward from two opposite sides of the second base board to be inserted in the corresponding first receiving recesses of the receptacle housing, a receiving chamber being formed between the second sidewalls for receiving the inserting wall therein; and a plurality of second terminals mounted to the second sidewalls and each having a U-shaped continuity body riding on the corresponding second sidewall, the continuity body including a first contact arm located in the receiving chamber against an inside of the corresponding second sidewall and a second contact arm against an outside of the corresponding second sidewall;

wherein the continuity body of the second terminal is clipped between the first and the second elastic arms of the corresponding first terminal, and the first and the second contact portions elastically contact the first and the second contact arms respectively.

2. The board-to-board connector assembly as claimed in claim 1, wherein the second elastic arm is bent towards the first elastic arm to show a lying-V shape in substance.

3. The board-to-board connector assembly as claimed in claim 1, wherein the second elastic arm has a higher top than the first elastic arm to make the second contact portion higher than the first contact portion.

4. The board-to-board connector assembly as claimed in claim 1, wherein the end of the base arm adjacent to the fixing arm further longitudinally extends to form a soldering portion located under the corresponding first sidewall.

5. The board-to-board connector assembly as claimed in claim 1, wherein each of the terminal passageways includes a second receiving cavity vertically defined at an inside of the first sidewall, a first receiving cavity vertically defined at one side of the inserting wall to face the second receiving cavity, a fixing perforation penetrating vertically through the corresponding first sidewall, and a connecting cavity longitudinally formed in the first base board to connect the first receiving cavity, the second receiving cavity and the fixing perforation, the base arm of the first terminal is received in the connecting cavity, the fixing arm is inserted in the fixing perforation, the first elastic arm is received in the first receiving cavity, the second elastic arm is received in the second receiving cavity, and the first and the second contact portions stretch into the corresponding first receiving recess.

6. The board-to-board connector assembly as claimed in claim 5, wherein an edge of the fixing arm protrudes outward to form a fixing projection abutting against an inside of the corresponding fixing perforation.

7. The board-to-board connector assembly as claimed in claim 1, wherein the second terminals are integrated to the second sidewalls of the plug housing, and free ends of the continuity body are embedded in the second base board.

8. The board-to-board connector assembly as claimed in claim 1, wherein the second terminal further has a soldering arm extended towards an opposite direction to the first contact arm from a free end of the second contact arm and projected out of a corresponding side edge of the second base board.

9. The board-to-board connector assembly as claimed in claim 1, wherein the first contact arm defines a first contact surface opposite to the second contact arm and the second contact arm defines a second contact surface opposite to the first contact arm and sunk inward, the first and the second contact portions electrically contact the first and the second contact surfaces respectively.

10. The board-to-board connector assembly as claimed in claim 1, wherein two opposite ends of the first base board protrude upward to form a pair of first end-walls each connecting two corresponding ends of the first sidewalls, two opposite ends of the inserting wall are spaced from the corresponding first end-walls to define a pair of second receiving recesses therebetween communicating with the first receiving recesses, two opposite ends of the second base board protrude downward to form a pair of second end-walls each connecting two corresponding ends of the second sidewalls and inserted in the corresponding second receiving recess.

11. The board-to-board connector assembly as claimed in claim 10, wherein each of the second end-walls has a lower bottom than the second sidewalls.

12. The board-to-board connector assembly as claimed in claim 10, wherein the receptacle connector further includes a pair of first fixing members mounted in one end of the first sidewalls respectively, each of the first fixing members has a base plate vertically disposed in the first sidewall and provided with an interference portion thereon, the interference portion faces the corresponding second receiving recess, the plug connector further includes a second fixing member mounted in the corresponding second end-wall, the second fixing member has a base bar provided with a pair of locking portions at two opposite ends thereof, the locking portions of the second fixing member pass across the corresponding interference portions of the two corresponding first fixing members to be locked under the corresponding interference portions.

13. The board-to-board connector assembly as claimed in claim 12, wherein the first fixing member further has a soldering tail extended towards an opposite direction to the interference portion from a bottom edge of the base plate and located under the corresponding first sidewall.

14. The board-to-board connector assembly as claimed in claim 12, wherein the one end of each first sidewall defines a fixing slot vertically penetrating therethrough and a connecting passage connecting a middle of the fixing slot and the corresponding second receiving recess, the base plate is fastened in the fixing slot and the interference portion projects into the connecting passage, the locking portions of the second fixing member oppositely project out of the corresponding second end-wall to be received in the corresponding connecting passages.

15. The board-to-board connector assembly as claimed in claim 12, wherein a substantial middle of the base bar extends upward to form an inserting portion, a bottom of each of the second end-walls defines a receiving channel extending longitudinally to penetrate therethrough for receiving the base bar therein, a substantial middle of the receiving channel extends upward to form an inserting aperture, the inserting portion is inserted in the inserting aperture.

16. The board-to-board connector assembly as claimed in claim 15, wherein a free end of the inserting portion oppositely protrudes to form a pair of fixing protrusions abutting against two facing insides of the corresponding inserting aperture.

17. The board-to-board connector assembly as claimed in claim 15, wherein two ends of the base bar further extend upward to form two fastening portions adjacent to the locking portions respectively, two ends of the receiving channel further extend upward to form a pair of receiving fillisters, the fastening portions are fastened in the corresponding receiving fillisters.

* * * * *